United States Patent [19]

Bush, deceased

[11] Patent Number: 4,467,639

[45] Date of Patent: Aug. 28, 1984

[54] APPARATUS AND METHOD FOR MEASURING GYROSCOPIC STABILITY

[75] Inventor: Clarence C. Bush, deceased, late of Bel Air, Md., by Florence Bush, administratrix

[73] Assignee: The United States of America as represented by the Secretary of the Army, Washington, D.C.

[21] Appl. No.: 478,754

[22] Filed: Mar. 25, 1983

[51] Int. Cl.[3] ..... G01M 1/16

[52] U.S. Cl. ..... 73/66; 73/167; 73/460

[58] Field of Search ..... 73/66, 460, 471, 167

[56] References Cited

U.S. PATENT DOCUMENTS 2,353,150 7/1944 Dietz ..... 73/167 X 2,478,663 8/1949 Masket et al. ..... 73/167 X

*Primary Examiner*—James J. Gill

*Attorney, Agent, or Firm*—Robert P. Gibson; Anthony T. Lane; Michael C. Sachs

[57] ABSTRACT

The apparatus and method are designed to allow a projectile to be supported in an external air bearing and spun up to a desired spin rate. When the desired spin drive is disengaged the projectile reacts freely to the gyroscopic forces in three degrees of angular motion. Spin loss, coning angle and nutation motion are measured as they vary with time.

12 Claims, 1 Drawing Figure

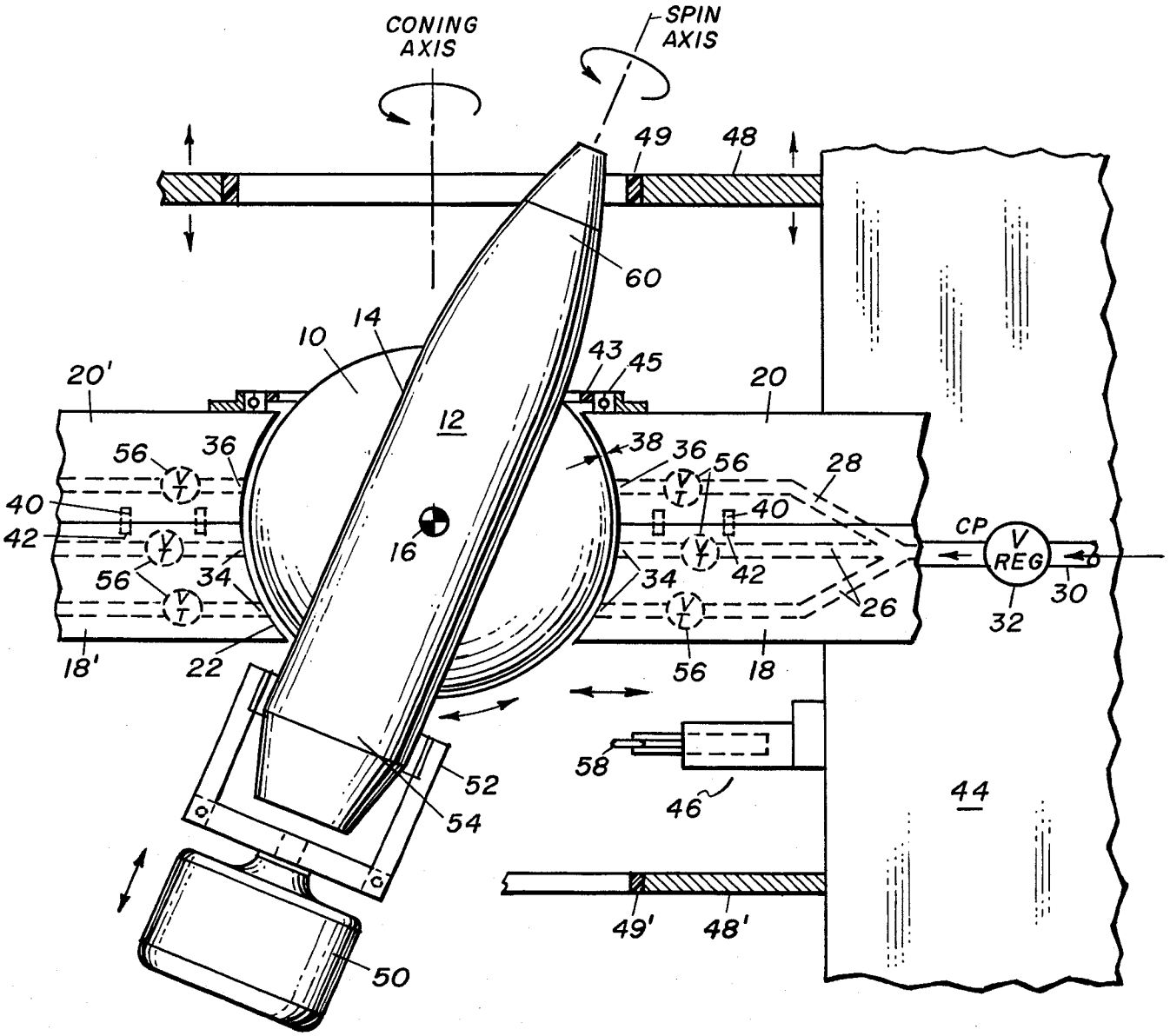
SPIN AXIS
CONING AXIS
CP
V REG
30
32
44
26
28
20
18
40
42
56
36
38
34
45
43
60
48
49
46
58
48'
49'
52
54
50
12
16
14
10
22
20'
18'

APPARATUS AND METHOD FOR MEASURING GYROSCOPIC STABILITY

GOVERNMENTAL INTEREST

The invention described herein may be manufactured, used and licensed by or for the Government for Governmental purposes without the payment to me of any royalty thereon.

BACKGROUND OF THE INVENTION

This invention relates to experimental apparatus and method for measuring gyroscopic stability of gun launched spinning projectiles. The present invention permits simulation of a spinning projectile in free-flight conditions for the purpose of providing real-time motion rate results without extensive data manipulation.

In the past, spin stability measurements were frequently made in fixtures employing the forced-mode principle. In this technique a fixture, having provision for holding and spinning a projectile and forcing a simultaneous coning motion, is used to determine the projectile's stability characteristics by computational means. In this procedure the projectile is permitted to despin freely while being held at a constant coning angle. The problem with this method is that inconsistancies in the friction of the supporting ball bearing races have led to questionable test results.

In the prior art devices which utilize spherical air bearings to test a spinning projectile model in a supersonic wind tunnel, it has been necessary to locate the support bearing inside the model and with a rear oriented strut to support the bearing and to minimize aerodynamic flow interference. The problem with the aforementioned apparatus is that the strut support severely limits excursions for most realistic model configurations.

SUMMARY OF THE INVENTION

In the present invention a projectile is supported in an external spherical air bearing, and spun up to a desired spin rate. When the spin drive is disengaged the projectile is left to react freely to gyroscopic forces as it is allowed to despin. The freely developed spin loss, coning angle and nutation motion are measured as they vary with time. An electromagnetic repulsion device is used to develop large initial yaw.

An object of the present invention is to provide an apparatus and method for measuring gyroscopic stability of gun launched spinning projectiles which substantially eliminates support bearing friction.

Another object of the present invention is to provide an apparatus and method for measuring gyroscopic stability of a spinning projectile having three degrees of angular freedom of motion.

A further object of the present invention is to provide an apparatus and method for measuring gyroscopic stability of a spinning projectile in an environment which will allow the projectile to respond substantially in the same manner as it would in free-flight.

For a better understanding of the present invention, together with other and further objects thereof, reference is made to the following descriptions taken in connection with the accompanying drawing.

BRIEF DESCRIPTION OF THE DRAWING

The drawing is a partial cut away diagramatic view of a projectile mounted in the spin fixture.

DESCRIPTION OF THE PREFERRED EMBODIMENTS

The spin fixture for measuring gyroscopic stability comprises a spherical shaped support body member 10 which fixedly holds a projectile 12 in a radially extending holding slot 14. Projectile 12 is located in holding slot 14 so that its center of gravity 16 is operatively disposed so that it is coindicent with a radial axis of ball body member 10. Body member 10 is supported by a lower female pole piece support members 18, 18' and an upper female pole piece support members 20, 20' having spherically contoured air bearing surfaces 22 and 24 respectively. A plurality of air passages 26 are located in the lower support members 18, 18' and a single air passageway 28 is located in the upper support members 20, 20'. Passageways 26 and 28 carry high pressure air from air supply source 30, at a controlled rate by an air pressure regulator 32, to exit orifices 34 and 36, respectively. Orifices 34 and 36 supply clean, dry pressurized air to the air bearing clearance space 38 located between the ball body member 10 and the spherically contoured air bearing surfaces 22 and 24. Air passages 26 in lower support members 18, 18' are designed to have larger flow capacity than passage 28 in the upper support members 20, 20' because the lower part of the air bearing support member 18, 18' must support the weight of the projectile 12 and the body member 10. The smaller air flow to the upper bearing surface area 24 can be considered as a cooling provision with limited usefulness as a stabilizing adjunct if the spinning projectile develops gyroscopically induced radial motions. The lower and upper pole piece members 18, 18' and 20, 20' include precisely meshing dowels 40 and locating holes 42. This permits upper and lower pole piece members 18 and 20 to be readily disassembled and reassembled when required by the insertion in the fixture of a new projectile for testing. A teflon lined element 43 is fixedly attached to a ball bearing race 45 which in turn is positioned on top of upper pole piece support member 20. The teflon lined ball bearing race 45 is used to minimize any damage to the projectile 12 by the fixture in the event the projectile gyrates wildly. Vertical frame 44 is used to support pole piece members 18 and 20, an electro-magnetic solenoid type horizontal repulsing device 46 and vertically restraining upper and lower hoops 48, 48' which have teflon lined inner member 49, 49' respectively are fixedly attached. An electric motor 50 is mechanically coupled to a gripping clutch type device 52 which releaseably engages the base 54 of projectile 12.

In operation when a projectile is ready for test, the support assembly 18, 18' and 20, 20' are supplied with air to raise the lower part of the ball support body member from metal-to-metal contact with lower support 18, 18'. The ball 10 is centered in supports 18, 18' and 20, 20' first by hand spinning the projectile 12 as the air supply pressure is adjusted by control of regulator 32 so that the ball 10 makes very slight or no contact with the lower and upper spherical pole piece surfaces 22 and 24 respectively. Pressure regulator 32 and manually-adjustable micrometer position-indicating throttle valves 56 are then adjusted to maintain the ball member 10 approximately midway between the lower and upper support members 18 and 18′ and 20 and 20′ respectively.

Spin-drive motor 50 and the gripping clutch device 52 are activated to engage projectile base 34 so that the projectile is brought up to a desired spin rate. If the projectile 12 does not immediately begin to yaw and nutate, when the clutch 52 is disengaged from the projectile 12, the projectile is given an initial yaw by the rubber wheel 58 of the electro-magnetic actuated repulser 46. The spin, coning and nutation motions are recorded versus time to provide the desired rate information related to gyroscopic stability. The teflon-lined race 45 and the restraining hoops 48, 48′ are both utilized to help restrain the gyrating projectile nose 60 whenever there is severe gyroscopic instability.

The foregoing disclosure and drawing are merely illustrative of the principles of this invention and are not to be interpreted in a limiting sense. I wish it to be understood that I do not desire to be limited to the exact detail of construction shown and described for obvious modifications will occur to a person skilled in the art.

What is claimed is:

1. An apparatus for measuring gyroscopic stability of a spinning projectile which comprises:

air bearing ball means for rotatably holding said projectile so that it can freely move in three degrees of angular motion;

motor means for providing torquing power to spin said projectile along a coning axis;

support member air bearing means for providing air bearing surfaces for said ball means, and for supplying pneumatically controlled air to said bearing surfaces;

pneumatic supply means operatively connected to said support member air bearing means for providing pressure regulated air to said support member air bearing means;

electro-magnetic repulsing means for providing an initial nutation to said spinning projectile; and hoop means for restraining said spinning projectile whenever there is severe gyroscopic instability.

2. An apparatus as recited in claim 1 wherein said ball means includes a spherically shaped support member having a radially extending holding slot therein for fixedly holding said projectile so that said projectile's center of gravity coincides with a radial axis of said spherically shaped support member.

3. An apparatus as recited in claim 2 wherein said motor means includes a gripping clutch means for releaseably holding said spinning projectile while said projectile is disposed in said ball means.

4. An apparatus as recited in claims 2 or 3 wherein said support member air bearing means includes:

a lower female pole piece support member having a plurality of air passages located therein and communicating with said pneumatic supply means, and an upper female pole piece support member having a single air passageway disposed therein and communicating with said pneumatic supply means.

5. An apparatus as recited in claim 4 wherein said plurality of air passages each include a manually adjustable micrometer throttle valve operatively disposed in said passages.

6. An apparatus as recited in claim 5 wherein said single air passage includes a manually adjusted micrometer throttle valve operatively located therein.

7. An apparatus as recited in claim 6 wherein said pneumatic supply means includes an air supply source, and an air pressure regulator for delivering air at a constant pressure to said plurality of air passages and to said single air passage.

8. An apparatus as recited in claim 7 wherein said electro-magnetic repulsing means includes a rotatably mounted rubber wheel for providing initial yaw to said spinning projectile.

9. an apparatus as recited in claim 8 wherein said hoop means includes:

a vertical frame support;

an upper restraining hoop fixedly attached to said frame support, said upper restraining hoop including an inner member made of such material as teflon;

a lower restraining hoop fixedly attached to said frame support, said lower restraining hoop including an inner member made of such material as teflon; and a teflon lined ball bearing race member fixedly disposed on top of said upper female pole piece support member.

10. A method for measuring the gyroscopic stability of a spinning projectile comprising the step of:

fixedly attaching said spinning projectile to an air bearing ball means so that its center of gravity coincides with a radial axis of said ball means;

adjusting a pheumatic supply means to introduce air into support member air bearing means to raise said ball means so that there is no metal-to-metal contact between said support member air bearing means and said ball means;

spinning said projectile manually while adjusting said pneumatic supply means so that said ball means makes very slight or no contact with said support member air bearing means;

readjusting said pneumatic supply means to maintain said projectile and ball means assembly so that the assembly is approximately located midway between upper and lower spherically shaped surfaces of female pole piece members of said support member air bearing means;

activating a spin-drive motor having a gripping clutch operatively attached thereto to grasp the base of said projectile;

rotating said projectile and ball means assembly at a decreased angular velocity;

disengaging said spinning projectile from said spin-drive motor and gripping clutch;

giving said spinning projectile an initial yaw; and recording the spin, coning, and nutation motions versus time to determine the free gyroscopic stability of said projectile in three degrees of angular motion.

11. A method as recited in claim 10 wherein the step of giving said spinning projectile an initial yaw includes actuating an electro-magnetic repulsing device.

12. A method as recited in claim 11 which further includes the step of positioning hoop means to limit the gyroscopic instability of said spinning projectile.

* * * * *